US009765639B2

(12) United States Patent
Kim et al.

(10) Patent No.: US 9,765,639 B2
(45) Date of Patent: Sep. 19, 2017

(54) GAS TURBINE ENGINE WITH EXIT FLOW DISCOURAGER

(71) Applicant: SOLAR TURBINES INCORPORATED, San Diego, CA (US)

(72) Inventors: Yong Weon Kim, San Diego, CA (US); Kidon Lee, Seoul (KR)

(73) Assignee: Solar Turbines Incorporated, San Diego, CA (US)

( * ) Notice: Subject to any disclaimer, the term of this patent is extended or adjusted under 35 U.S.C. 154(b) by 801 days.

(21) Appl. No.: 14/152,897

(22) Filed: Jan. 10, 2014

(65) Prior Publication Data

US 2015/0198053 A1 Jul. 16, 2015

(51) Int. Cl.
*F01D 11/02* (2006.01)
*F01D 11/00* (2006.01)

(52) U.S. Cl.
CPC ..... *F01D 11/02* (2013.01); *F01D 11/001* (2013.01)

(58) Field of Classification Search
CPC ..... F01D 11/00; F01D 11/02; F01D 11/04; F01D 11/001; F01D 25/12; F01D 5/084; F01D 5/087; F01D 9/065; F05D 2240/55; F16J 14/447; F16J 15/4472; F16J 15/4474
USPC ..... 415/174.5, 173.7; 277/409, 411, 412, 277/415, 418, 419
See application file for complete search history.

(56) References Cited

U.S. PATENT DOCUMENTS

| | | | | |
|---|---|---|---|---|
| 4,218,189 | A | 8/1980 | Pask | |
| 5,222,742 | A | 6/1993 | Roberts | |
| 7,234,918 | B2 * | 6/2007 | Brillert | F01D 11/025 415/173.5 |
| 7,430,802 | B2 * | 10/2008 | Tiemann | F01D 5/3015 29/889.22 |
| 8,016,552 | B2 | 9/2011 | Bunker | |
| 8,388,310 | B1 | 3/2013 | Diakunchak | |
| 2008/0056889 | A1 | 3/2008 | Cheng et al. | |
| 2009/0003996 | A1 | 1/2009 | Tiemann et al. | |
| 2010/0074733 | A1 | 3/2010 | Little | |
| 2010/0254806 | A1 | 10/2010 | Deodhar et al. | |
| 2013/0058756 | A1 | 3/2013 | Tham et al. | |

* cited by examiner

*Primary Examiner* — Ninh H Nguyen
*Assistant Examiner* — Brian P Wolcott
(74) *Attorney, Agent, or Firm* — Procopio, Cory, Hargreaves & Savitch LLP; James R. Smith

(57) ABSTRACT

A turbine stage for a gas turbine engine is disclosed. The turbine stage includes a turbine disk and a turbine diaphragm, forming a cavity there between. The turbine stage also includes an exit flow discourager comprised of at least two teeth. The teeth may be located radially apart from each other, each tooth including a length extending in the axial direction and a width extending in the radial direction. A channel is formed between the teeth and an axially adjacent surface. A recirculation region may be formed in between each pair of teeth.

20 Claims, 5 Drawing Sheets

GAS TURBINE ENGINE WITH EXIT FLOW DISCOURAGER

TECHNICAL FIELD

The present disclosure generally pertains to gas turbine engines, and is more particularly directed toward a turbine with an exit flow discourager configured for maintaining downstream components.

BACKGROUND

Gas turbine engines include compressor, combustor, and turbine sections. Portions of a gas turbine engine are subject to high temperatures. In particular, hot air flow across the blades of a turbine can bleed into air cavities within the turbine. This hot air may elevate the temperatures of the cavities and reduce the longevity of the components.

U.S. Pat. No. 4,218,189 to G. Pask discloses a bladed rotor for a gas turbine engine comprising a rotor disc having a plurality of blade retaining slots in its periphery and a rotor blade mounted in each slot, and sealing means between the rotor and the adjacent static structure comprising an annular projection from adjacent the disc periphery adapted to co-act with an annular feature on the static structure.

The present disclosure is directed toward overcoming one or more of the problems discovered by the inventors.

SUMMARY OF THE DISCLOSURE

A gas turbine engine turbine stage is disclosed. The turbine stage includes a turbine diaphragm and a turbine disk. The turbine diaphragm is located adjacent the turbine disk. The turbine disk and the turbine diaphragm form a cavity there between. The turbine disk includes an annular flat surface. The turbine diaphragm includes an outer circumference and an axial facing surface. The turbine diaphragm also includes an exit flow discourager located adjacent the axial facing surface of the turbine diaphragm and axially spaced apart form the annular flat surface of the turbine disk. The exit flow discourager includes an annular first tooth axially extending a first length from the axial facing surface of the turbine diaphragm towards the annular flat surface of the turbine disk. The first tooth radially extends a first width along a base of the first tooth proximate the outer circumference of the turbine diaphragm. The exit flow discourager also includes an annual second tooth axially extending a second length from the axial facing surface of the turbine diaphragm towards the annular flat surface of the turbine disk. The second tooth radially extends a second width along a base of the second tooth. The second tooth is radially spaced a first distance from the first tooth forming a first recirculation region there between.

DETAILED DESCRIPTION

The systems and methods disclosed herein include an exit flow discourager for a turbine stage of a gas turbine engine. The exit flow discourager may be located on one or more turbine diaphragms of the gas turbine engine, and/or turbine disks of the gas turbine engine. The exit flow discourager may employ teeth to discourage air flow. The teeth may increase the pressure of the cooling air flowing through certain cavities, such as the cavity between a turbine diaphragm and a turbine disk. The teeth may prevent ingestion of hot combustion gases into the cavity. The increase in pressure may reduce the temperature within the cavity and prolong the service life of the gas turbine engine components.

Figure 1:
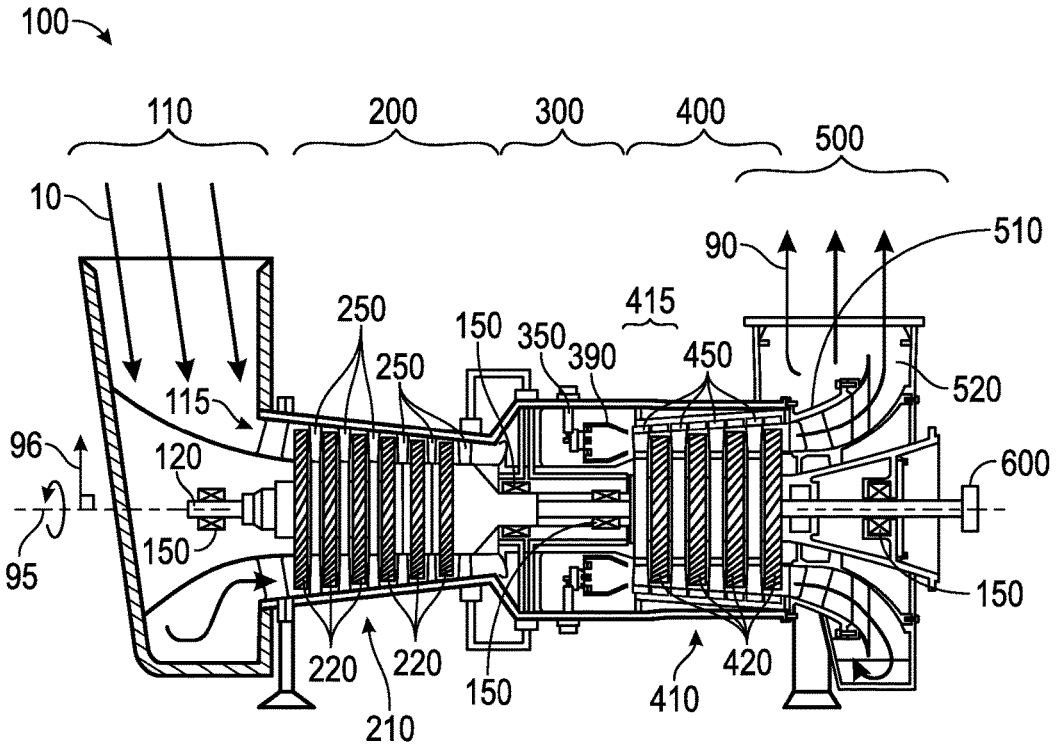
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or "compressor" 200, a combustor 300, a turbine 400, an exhaust 500, and a power output coupling 600. The gas turbine engine 100 may have a single shaft or a dual shaft configuration.

The compressor 200 includes a compressor rotor assembly 210 and compressor stationary vanes ("stators") 250. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially precede each of the compressor disk assemblies 220. Each compressor disk assembly 220 paired with the adjacent stators 250 that precede the compressor disk assembly 220 is considered a compressor stage. Compressor 200 includes multiple compressor stages.

The combustor 300 includes one or more injectors 350 and includes one or more combustion chambers 390.

The turbine 400 includes a turbine rotor assembly 410, turbine nozzles 450, and one or more turbine diaphragms 460. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk 430 (shown in FIG. 2) that is circumferentially populated with turbine blades 440 (shown in FIG. 2). Turbine nozzles 450 axially precede each of the turbine disk assemblies 420. The turbine diaphragm 460 may support turbine nozzles 450 and may be located radially inward from turbine nozzles 450. Each turbine disk assembly 420 paired with the adjacent turbine diaphragm 460 and turbine nozzles 450 that precede the turbine disk assembly 420 is considered a turbine stage. Turbine 400 includes multiple turbine stages. The exhaust 500 includes an exhaust diffuser 510 and an exhaust collector 520. The power output coupling 600 may be located at the end of shaft 120.

Figure 2:
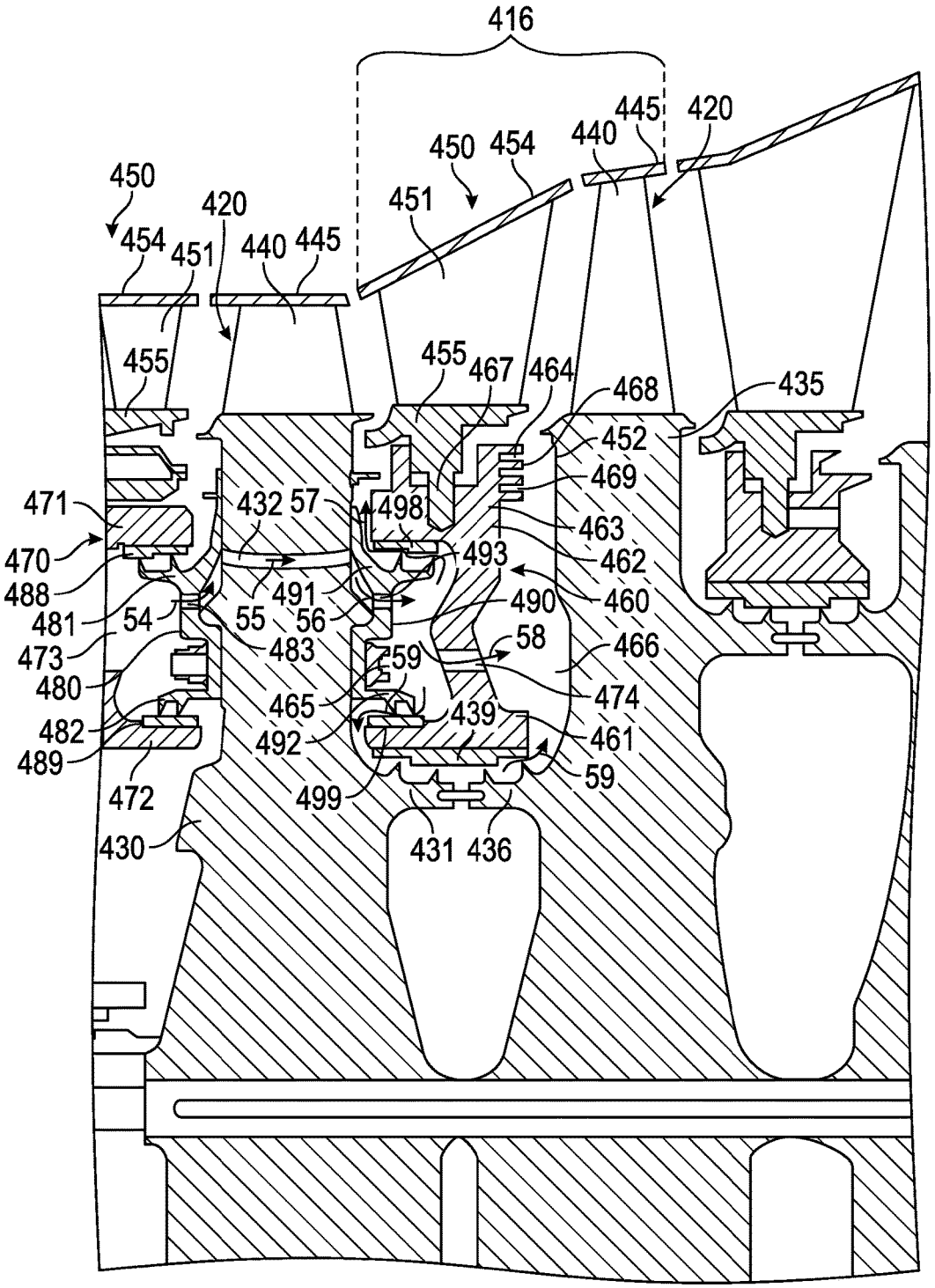
FIG. 2 is a cross sectional view of a portion of the gas turbine engine turbine of FIG. 1.

FIG. 2 is a cross-sectional view of a portion of the turbine 400 of FIG. 1. All references to radial, axial, and circumferential directions and measures for elements of turbine diaphragm 460 refer to the axis of turbine diaphragm 460, which is concentric to center axis 95.

Turbine diaphragm 460 may include inner cylindrical portion 461, disk portion 462, and mounting portion 463. Inner cylindrical portion 461 may be in the form of a hollow circular cylinder with a variable thickness, defining a bore there within. Mounting portion 463 may be a circular piece and may be located radially outward from inner cylindrical portion 461. As shown in FIG. 2, mounting portion 463 may be located radially inward from turbine nozzles 450 and may be configured to couple with turbine nozzles 450. Mounting portion 463 may include mounting holes 467. Disk portion 462 may include diaphragm hole 474.

Disk portion 462 may extend radially between inner cylindrical portion 461 and mounting portion 463. Disk portion 462 may also extend axially forward and axially aft while spanning radially between inner cylindrical portion 461 and mounting portion 463. Disk portion 462 may also have a variable thickness. Inner cylindrical portion 461, disk portion 462, and mounting portion 463 circumferentially extend completely around the axis of the turbine diaphragm 460. Inner cylindrical portion 461, mounting portion 463, and disk portion 462 may be configured to form a first cavity 465 located axially forward of disk portion 462 and radially between mounting portion 463 and inner cylindrical portion 461.

Each turbine stage may include an exit flow discourager 464. In the embodiment illustrated in FIG. 2, the exit flow discourager 464 is located in the second turbine stage 416. In some embodiments, forward diaphragm 470 is a first stage diaphragm, first turbine disk 430 is a first stage turbine disk, turbine diaphragm 460 is a second stage diaphragm, and second turbine disk 435 is a second stage turbine disk.

Still referring to FIG. 2, each turbine nozzle 450 includes an outer wall 454, an inner wall 455, and a nozzle blade 451. Each outer wall 454 has an arcuate shape and connects to the turbine housing (not shown). An inner wall 455 is located radially inward from outer wall 454. Each inner wall 455 has an arcuate shape and may connect to turbine diaphragm 460 at mounting portion 463. One or more nozzle blades 451 span between outer wall 454 and inner wall 455.

A turbine disk assembly 420 may be axially forward of turbine diaphragm 460 and includes first turbine disk 430 with multiple turbine blades 440. Another turbine disk assembly 420 may be axially aft of turbine diaphragm 460 and includes second turbine disk 435 with multiple turbine blades 440. First turbine disk 430 and second turbine disk 435 may be configured with a bore (not shown) for coupling to shaft 120 (shown in FIG. 1). First turbine disk 430 may include disk holes 432. The first cavity 465 may be bound by an aft facing surface of first turbine disk 430. The axially forward facing surface of second turbine disk 435 and turbine diaphragm 460 may define a second cavity 466. In other embodiments, the exit flow discourager is located on a turbine disk (not shown).

First turbine disk 430 may also include first labyrinth threads 431 extending axially aft and radially outward. Second turbine disk 435 may include second labyrinth threads 436 extending axially forward and radially outward. The second labyrinth threads 436 may be located axially aft of the first labyrinth threads 431. Both first labyrinth threads 431 and second labyrinth threads 436 may be located radially inward of turbine diaphragm 460. Bore running surface 439 may be located radially inward of and radially adjacent to turbine diaphragm 460 and may be within the bore of turbine diaphragm 460. In the embodiment shown in FIG. 2, first labyrinth threads 431, second labyrinth threads 436, and bore running surface 439 form a labyrinth seal within the bore of turbine diaphragm 460.

Turbine blades 440 may be installed axially or circumferentially onto first turbine disk 430 and second turbine disk 435. Turbine 400 also includes shrouds 445 located radially outward and spaced apart from turbine blades 440. Shrouds 445 may attach to the turbine housing (not shown).

The turbine 400 may also include a forward diaphragm 470, a forward labyrinth seal 480, and an aft labyrinth seal 490. The forward diaphragm 470 is located axially forward of first turbine disk 430. Forward diaphragm 470 may also be configured to couple with turbine nozzles 450. The axially aft end of the third cavity 473 may be bound by the axially forward facing surface of first turbine disk 430.

Forward labyrinth seal 480 may be located within third cavity 473 between forward diaphragm 470 and first turbine disk 430. Forward labyrinth seal 480 may be coupled to first turbine disk 430 at the forward axial face of first turbine disk 430. Forward labyrinth seal 480 includes forward outer labyrinth threads 481, forward inner labyrinth threads 482, forward labyrinth hole 483, forward outer running surface 488, and forward inner running surface 489. Forward outer running surface 488 may be adjacent outer portion 471 and forward outer labyrinth threads 481. Forward outer running surface 488 may be radially inward from outer portion 471 and radially outward from forward outer labyrinth threads 481. Forward inner running surface 489 may be adjacent inner portion 472 and forward inner labyrinth threads 482. Forward inner running surface 489 may be located radially outward from inner portion 472 and radially inward from forward inner labyrinth threads 482.

Aft labyrinth seal 490 may be located within first cavity 465 between turbine diaphragm 460 and first turbine disk 430. Aft labyrinth seal 490 may be coupled to first turbine disk 430 at the aft axial face of first turbine disk 430. Aft labyrinth seal 490 includes aft outer labyrinth threads 491, aft inner labyrinth threads 492, aft labyrinth hole 493, aft outer running surface 498, and aft inner running surface 499. Aft outer running surface 498 may be adjacent mounting portion 463 and aft outer labyrinth threads 491. Aft outer running surface 498 may be radially inward from mounting portion 463 and radially outward from aft outer labyrinth threads 491. Aft inner running surface 499 may be adjacent inner cylindrical portion 461 and aft inner labyrinth threads 492. Aft inner running surface 499 may be located radially outward from cylindrical portion 461 and radially inward from aft inner labyrinth threads 492.

Figure 3:
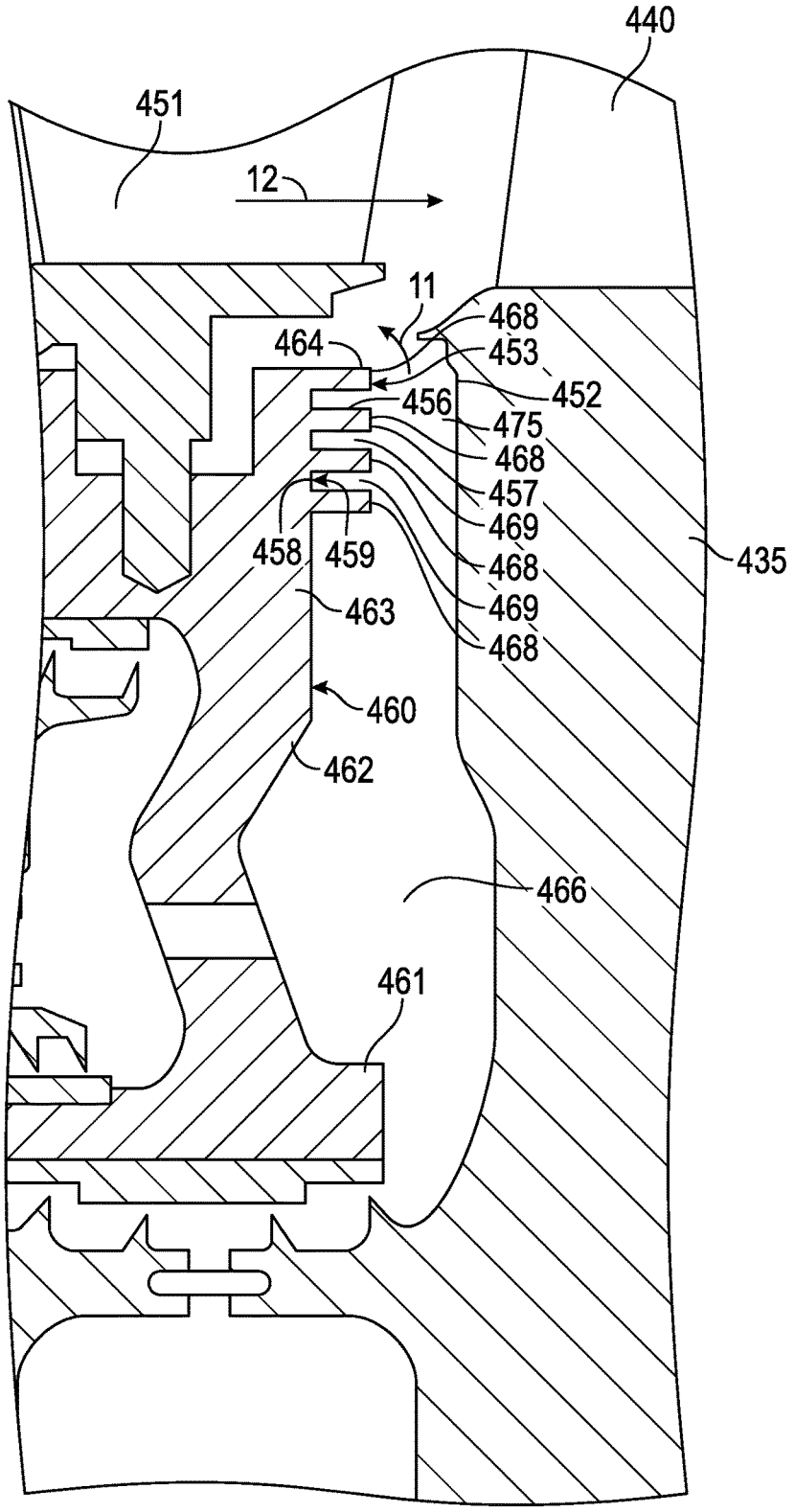
FIG. 3 is a cross sectional view of the portion of the gas turbine engine turbine diaphragm of FIG. 2.

FIG. 3 is an enlarged cross section view of the turbine depicted in FIG. 2, focusing on the turbine diaphragm 460 and second turbine disk 435 (hereinafter generally referred to as turbine disk 435). The exit flow discourager 464 may be located adjacent the turbine diaphragm 460. The exit flow discourager 464 may include teeth 468 and recirculation regions 469. In some embodiments, the teeth are annular. The exit flow discourager 464 may include two or more teeth 468 located in an annular pattern on the aft surface 459 of the mounting portion 463. In some embodiments, the exit flow discourager 464 includes two, three, four, five, or six teeth.

Each tooth may have a tooth depth (or sometimes referred to as length of the tooth) 456 and a tooth width 457. In some embodiments, the tooth depth 456 may range from 0.102 cm (0.04 in) to 30.48 cm (12 in). In some embodiments, the length of the tooth width 457 may range from 0.102 cm (0.04 in) to 10.16 cm (4 in). In some embodiments, the tooth width can be measured at a base of the tooth. In some embodiments, the aspect ratio of the tooth depth to the tooth width may be 2:1. In some embodiments, the tooth depth of all of the teeth are the same. In some embodiments, the tooth width of all of the teeth are the same.

In some embodiments, each tooth 468 may be an annular shape with a rectangular cross-section. In other embodiments, each tooth 468 may be an annular shape with a triangular or circular cross-section. In some embodiments, each tooth 468 may feature a taper along the tooth depth or the tooth width. In some embodiments, each tooth 468 may feature a chamfer or round along the tooth depth or the tooth width. The aft tooth surface 453 may feature a rounded surface or a flat surface. Each tooth may extend circumferentially about the aft surface 459 of the mounting portion 463, and extend axially aft of the aft surface 459 of the mounting portion 463, forming a channel in between each pair of teeth. In some embodiments, the teeth 468 may extend towards a flat annular surface 452 of the turbine disk 435. The teeth of the exit flow discourager 464 may be located as an annular pattern of teeth beginning proximate to the outer surface of the diaphragm 460 and extending radially inward from the outer surface of the diaphragm 460. In some embodiments, the row of teeth may extend radially inward onto the disk portion 462 (not shown).

The exit flow discourager may include a distance between the axial end of all teeth 468 and the adjacent axial wall of the turbine disk (hereinafter referred to as disk-diaphragm gap 475). In some embodiments, the disk-diaphragm gap 475 may be constant across all teeth.

Each recirculation region 469 may be geometrically defined by tooth depth 456 and channel wall 458. In some embodiments, the length of the channel wall 458 may range from 0.102 cm (0.04 in) to 30.48 cm (12 in). In some embodiments, the tooth depth 456 may range from 0.102 cm (0.04 in) to 30.48 cm (12 in). In some embodiments, the aspect ratio of the tooth depth 456 to the channel wall 458 may range from 0.5 to 10. The aforementioned aspect ratios may each correlate to the effectiveness of the exit flow discourager.

Recirculation regions 469 may be located in the channel formed between each pair of teeth 468 of the exit flow discourager 464. In some embodiments, the recirculation region 469 includes the channel between a pair of teeth and the channel between the aft tooth surface 453 and the forward surface of the turbine disk 435. The recirculation regions may produce buffer air 11 to decrease the ingress of hot gas flow 12 flowing from the combustion stage.

Figure 4:
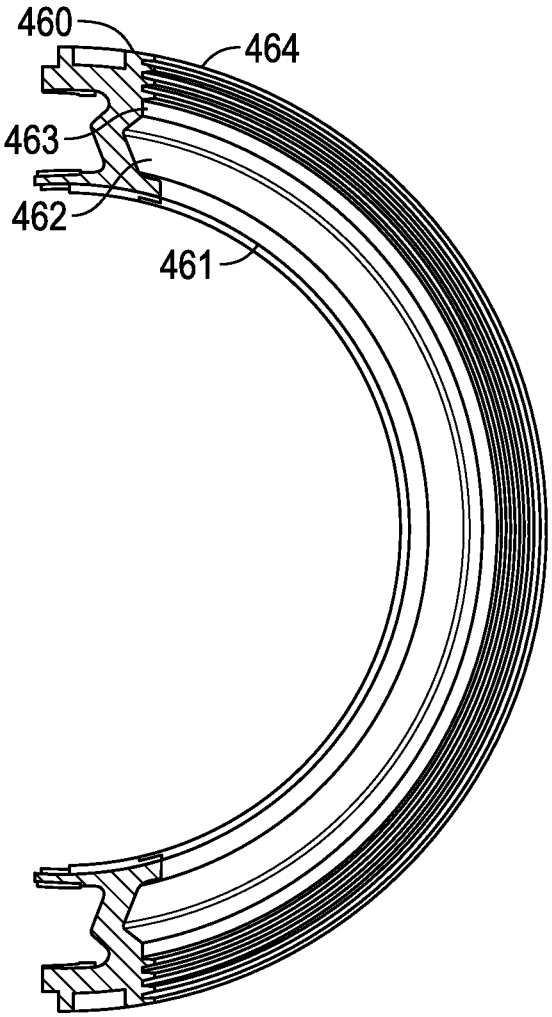
FIG. 4 is a cross sectional perspective view of the gas turbine engine turbine diaphragm of FIG. 3.

FIG. 4 is a cross sectional perspective view of the turbine diaphragm 460 shown in FIG. 3. As shown in the figure, the teeth extend from the mounting portion 463 and extend circumferentially about the aft surface of the mounting portion 463. Furthermore, the teeth may be uniformly shaped. In some embodiments, the teeth extend inward into the disk portion 462. In some embodiments, the first tooth located adjacent the outer circumference of the turbine diaphragm 460 may be longer or wider than the rest of the teeth (not shown).

Figure 5:
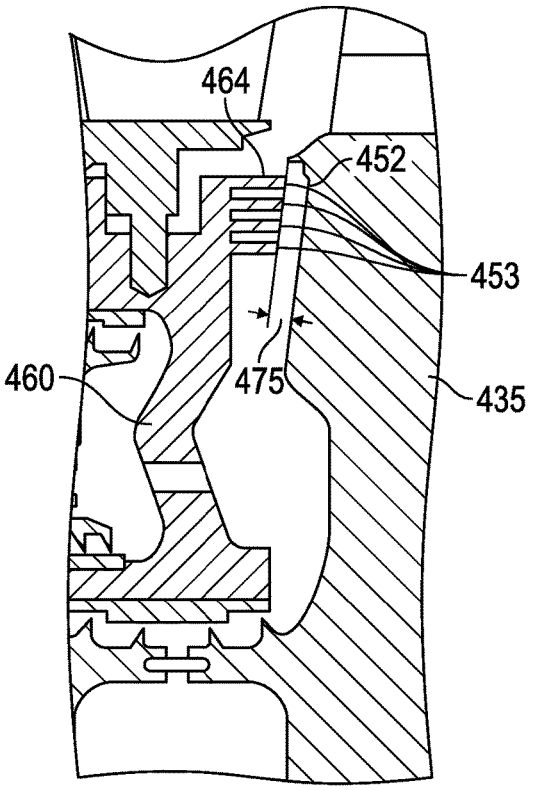
FIG. 5 is a cross sectional view of a gas turbine engine turbine.

FIG. 5 is a cross sectional view of an embodiment of a gas turbine engine turbine. As shown in the figure, the aft tooth surface 453 of each tooth may be angled. The angle of the aft tooth surface 453 may be parallel to the flat annular surface 452 of the second turbine disk 435. In such embodiments, the disk-diaphragm gap 475 may be constant across all the teeth.

Figure 6:
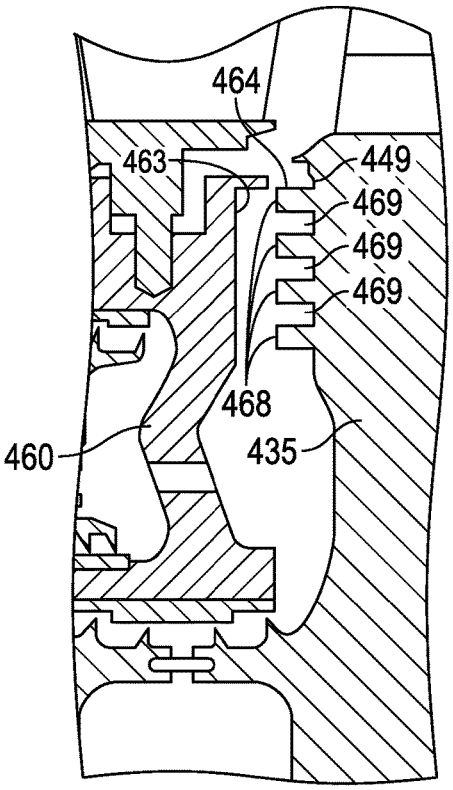
FIG. 6 is a cross sectional view of a gas turbine engine turbine.

FIG. 6 is a cross sectional view of an alternative embodiment of a gas turbine engine turbine. As shown in the figure, the exit flow discourager 464 may be located on a forward surface 449 of the second turbine disk 435. In such embodiments, the teeth 468 may extend axially from the forward surface 449 of the second turbine disk 435 towards the turbine diaphragm 460. In some embodiments, the teeth 468 may extend axially towards the mounting portion 463 of the turbine diaphragm 460. Furthermore, in some embodiments the mounting portion 463 is flat. As shown in the figure, recirculation regions 469 may form in between each pair of teeth 468. In such embodiments, the teeth may impose structural challenges to the construction of the turbine disk.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance.

Superalloys may include materials such as alloy x, WASPALOY, RENE alloys, alloy 188, alloy 230, INCOLOY, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction—going from the inlet 110 towards the exhaust 500). Likewise, each turbine disk assembly 420 may be associated with a numbered stage.

Once compressed air 10 leaves the compressor 200, it enters the combustor 300, where it is diffused and fuel 20 is added. Air 10 and fuel 20 are injected into the combustion chamber 390 via injector 350 and ignited. After the combustion reaction, energy is then extracted from the combusted gas via the turbine 400 by each stage of the series of turbine disk assemblies 420. Exhaust gas 90 may then be diffused in exhaust diffuser 510 and collected, redirected, and exit the system via an exhaust collector 520. Exhaust gas 90 may also be further processed (e.g., to reduce harmful emissions, and/or to recover heat from the exhaust gas 90).

Operating efficiency of a gas turbine engine generally increases with a higher combustion temperature. Thus, there is a trend in gas turbine engines to increase the temperatures. Gas reaching forward stages of a turbine from a combustion chamber may be 1000 degrees Fahrenheit or more. To operate at such high temperatures a portion of compressed air of a compressor of a gas turbine engine may be diverted through internal passages or chambers to cool various components of a turbine such as turbine diaphragms and turbine disks. In some operations, the turbine blade speed may be in excess of 10,000 rpm.

Gas reaching forward stages of a turbine may also be under high pressure. Cooling air diverted from a compressor may need to be at compressor discharge pressure to effectively cool turbine components located in forward stages of a turbine. Gas turbine engine 100 components such as second turbine disk 435 may be subject to elevated levels of stress.

Cooling air with a substantially axial flow is diverted from the compressor discharge. Referring to FIG. 2, the cooling air from the compressor discharge may pass through forward diaphragm 470 to the path for cooling air 54. Compressor discharge air may exit the preswirler with a tangential component that may match the angular velocity of first turbine disk 430. Cooling air may travel along path for cooling air 54 from third cavity 473, through forward labyrinth hole 483 of forward labyrinth seal 480, and into first turbine disk 430 and to path for cooling air 55.

Path for cooling air 55 may pass axially through first turbine disk 430 along disk holes 432. A portion of the cooling air may be diverted radially outward to cool turbine blades 440 that circumferentially surround first turbine disk 430. The remainder of the cooling air may continue along path for cooling air 55 and exits disk holes 432 on the aft side of first turbine disk 430 to path for cooling air 56. Path for cooling air 56 may pass through aft labyrinth hole 493 and into first cavity 465. While a particular path along paths for cooling air 54, 55, and 56 has been described, alternate paths from the compressor discharge to first cavity 465 may be used.

Cooling air from the compressor discharge may be directed to the second cavity 466 to cool the second turbine disk 435. Cooling air from the compressor discharge entering first cavity 465 may exit first cavity 465 and travel to second cavity 466 along path for cooling air 59. A portion of the cooling air may also travel along path for cooling air 57 radially outward towards a gap between a radial outer edge of first turbine disk 430 and inner wall 455. Cooling air may also travel from first cavity 465 through diaphragm hole 474 and into second cavity 466 along path 58.

Cooling air following path for cooling air 59 may pass through aft labyrinth seal 490 between aft inner labyrinth threads 492 and aft inner running surface 499, as well as a labyrinth seal formed by first labyrinth threads 431, second labyrinth threads 436, and bore running surface 439. The cooling air 59 flows into the second cavity 466 to cool the second turbine disk 435. The cooling air into the second cavity 466 may also come from other places.

The effectiveness of the cooling air may be reduced by ingress of hot combusted gas from hot gas flow 12 and into a cavity between a diaphragm and an adjacent disk, such as second cavity 466. As seen in FIG. 3, the hot gas flow 12 flows past turbine blade 440 and nozzle blade 451 and may bleed into the second cavity 466. This may reduce the effectiveness of the cooling air that travels into second cavity 466. Ingestion of the hot gas flow 12 may reduce the service life of certain gas turbine engine components by increasing the temperature within second cavity 466. The exit flow discourager 464 may prevent or reduce the ingestion of combusted gas and may increase the life of the gas turbine engine components. The teeth and recirculation regions may create a more tortuous path, which may increase the pressure of the cooling air above that of the pressure of the combusted gas. During operation, this higher pressure boundary may produce buffer air 11 that combats the ingress of hot air flow 12.

The preceding detailed description is merely exemplary in nature and is not intended to limit the invention or the application and uses of the invention. The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A turbine stage of a gas turbine engine, the turbine stage comprising:

a turbine disk including an annular flat surface, a turbine diaphragm located adjacent the turbine disk, the turbine disk and the turbine diaphragm forming a cavity there between;

the turbine diaphragm including:

an outer circumference, an axial facing surface, and an exit flow discourager located on the axial facing surface of the turbine diaphragm opposite to and spaced apart from the annular flat surface of the turbine disk;

the exit flow discourager including:

a first annular tooth extending a first length from the axial facing surface of the turbine diaphragm towards the annular flat surface of the turbine disk, and extending a first width along a first base of the first annular tooth proximate the outer circumference of the turbine diaphragm;

a second annular tooth extending a second length from the axial facing surface of the turbine diaphragm towards the annular flat surface of the turbine disk, the second annular tooth radially spaced a first distance from the first annular tooth, forming a first recirculation region there between, and extending a second width along a second base of the second annular tooth;

a third annular tooth extending a third length and a third width, the third annular tooth radially spaced a second distance from the second annular tooth forming a second recirculation region there between; and a fourth annular tooth extending a fourth length and a fourth width, the fourth annular tooth radially spaced a third distance from the third annular tooth forming a third recirculation region there between; and wherein the first length is greater than the second length, third length, and fourth length.

2. The turbine stage of claim 1, wherein the first tooth, second tooth, third tooth, and fourth tooth each include a width between 0.04 inches to 4 inches and a length between 0.04 inches to 12 inches, and the first distance, second distance, and third distance each include a length between 0.04 inches to 12 inches.

3. The turbine stage of claim 1, wherein the first distance, second distance, and third distance include the same radial length.

4. The turbine stage of claim 1, wherein the recirculation regions are configured to create an air flow buffer during operation of the gas turbine engine.

5. The turbine stage of claim 4, wherein the air flow buffer inhibits the ingestion of hot gas flow into the cavity.

6. The turbine stage of claim 1, wherein the distance between the exit flow discourager and the annular flat surface of the turbine disk is constant.

7. The turbine stage of claim 6, wherein each tooth of the exit flow discourager includes an angled surface, the angled surface of each tooth parallel to the annular flat surface of the turbine disk.

8. The turbine stage of claim 1, wherein the length to width ratio of each tooth is about 2:1.

9. The turbine stage of claim 1, wherein the aspect ratio of the first length to the first distance, the second length to the second distance, the third length to the third distance, and the fourth length to the fourth distance is between 0.5 to 10.

10. The turbine stage of claim 1, wherein each tooth has a tapered rectangular cross-section.

11. A turbine stage of a gas turbine engine, the turbine stage comprising:

a turbine disk including an annular flat surface, a turbine diaphragm located adjacent the turbine disk, the turbine disk and the turbine diaphragm forming a cavity there between;

the turbine diaphragm including:

an outer circumference, an axial facing surface, and an exit flow discourager located on the axial facing surface of the turbine diaphragm opposite to and spaced apart from the annular flat surface of the turbine disk;

the exit flow discourager including:

a first annular tooth extending a first length from the axial facing surface of the turbine diaphragm towards the annular flat surface of the turbine disk, and extending a first width along a first base of the first annular tooth proximate the outer circumference of the turbine diaphragm;

a second annular tooth extending a second length from the axial facing surface of the turbine diaphragm towards the annular flat surface of the turbine disk, the second annular tooth radially spaced a first distance from the first annular tooth, forming a first recirculation region there between and extending a second width along a second base of the second annular tooth;

a third annular tooth extending a third length and a third width, the third annular tooth radially spaced a second distance from the second annular tooth forming a second recirculation region there between; and a fourth annular tooth extending a fourth length and a fourth width, the fourth annular tooth radially spaced a third distance from the third annular tooth forming a third recirculation region there between; and wherein the distance between the exit flow discourager and the annular flat surface of the turbine disk is constant; and wherein each tooth of the exit flow discourager includes an angled surface, the angled surface of each tooth parallel to the annular flat surface of the turbine disk.

12. The turbine stage of claim 11, wherein the first tooth, second tooth, third tooth, and fourth tooth each include a width between 0.04 inches to 4 inches and a length between 0.04 inches to 12 inches, and the first distance, second distance, and third distance each include a length between 0.04 inches to 12 inches.

13. The turbine stage of claim 11, wherein the first distance, second distance, and third distance include the same radial length.

14. The turbine stage of claim 11, wherein the first length is greater than the second length, third length, and fourth length.

15. The turbine stage of claim 11, wherein the length and width of all the teeth are the same.

16. The turbine stage of claim 11, wherein the recirculation regions are configured to create an air flow buffer during operation of the gas turbine engine.

17. The turbine stage of claim 16, wherein the air flow buffer inhibits the ingestion of hot gas flow into the cavity.

18. The turbine stage of claim 11, wherein the length to width ratio of each tooth is about 2:1.

19. The turbine stage of claim 11, wherein the aspect ratio of the first length to the first distance, the second length to the second distance, the third length to the third distance, and the fourth length to the fourth distance is between 0.5 to 10.

20. The turbine stage of claim 11, wherein each tooth has a tapered rectangular cross-section.

* * * * *